US007173190B2

(12) United States Patent
Bothe et al.

(10) Patent No.: US 7,173,190 B2
(45) Date of Patent: Feb. 6, 2007

(54) FLEXIBLE FLAT CONDUCTOR WITH INTEGRATED OUTPUT FILTER

(75) Inventors: Michael Bothe, Munster (DE); Stefan Mörbe, Hasbergen (DE)

(73) Assignee: FRIWO Mobile Power GmbH, Ostbevern (DE)

( * ) Notice: Subject to any disclaimer, the term of this patent is extended or adjusted under 35 U.S.C. 154(b) by 0 days.

(21) Appl. No.: 11/012,081

(22) Filed: Dec. 14, 2004

(65) Prior Publication Data

US 2005/0139379 A1 Jun. 30, 2005

(30) Foreign Application Priority Data

Dec. 16, 2003 (DE) ..... 103 58 911

(51) Int. Cl.
*H01B 7/00* (2006.01)

(52) U.S. Cl. ..... 174/113 R; 174/117 R; 174/117 F; 174/117 FF

(58) Field of Classification Search ..... 174/110 R, 174/113 R, 117 R, 117 F, 117 FF
See application file for complete search history.

(56) References Cited

U.S. PATENT DOCUMENTS

| | | | | |
|---|---|---|---|---|
| 3,239,916 | A * | 3/1966 | Edgar | 29/825 |
| 3,586,757 | A | 6/1971 | Haldeman, Jr. | |
| 4,845,311 | A * | 7/1989 | Schreiber et al. | 174/36 |
| 6,265,655 | B1 * | 7/2001 | Schweighofer | 174/32 |
| 6,465,732 | B1 * | 10/2002 | Dueweke | 174/36 |
| 6,486,394 | B1 * | 11/2002 | Schmidt et al. | 174/36 |
| 6,974,906 | B2 * | 12/2005 | Lo | 174/36 |
| 7,015,393 | B2 * | 3/2006 | Weiner et al. | 174/36 |
| 2004/0173369 | A1 * | 9/2004 | Cherniski et al. | 174/36 |

FOREIGN PATENT DOCUMENTS

| | | | |
|---|---|---|---|
| DE | 2952441 | | 7/1980 |
| DE | 3632281 | | 4/1988 |
| DE | 9104160.0 UI | | 8/1991 |
| DE | 42 12 371 | | 10/1992 |
| DE | 4212371 A | * | 10/1992 |
| DE | 4446533 | | 3/1996 |
| DE | 4446533 A | * | 3/1996 |
| DE | 10001942 | | 8/2001 |
| DE | 10018229 | | 10/2001 |
| DE | 10157678 | * | 6/2003 |
| JP | 6-139831 | * | 5/1994 |
| JP | 06139831 | | 5/1994 |
| JP | 2001128350 | | 5/2001 |
| WO | WO 01/21521 | | 3/2001 |

* cited by examiner

*Primary Examiner*—William H. Mayo, III
(74) *Attorney, Agent, or Firm*—Michael Best & Friedrich LLP

(57) ABSTRACT

A flexible flat conductor and a power supply unit including the flexible flat conductor. The flexible flat conductor includes at least two electrically conductive layers which are at least partially surrounded by an electrically insulating cover. The electrically conductive layers are insulated from one another by at least one dielectric layer arranged therebetween. At least a first one of the electrically conductive layers is patterned in at least one subarea thereof by openings in such a way that a plurality of meandrous elements is formed. The meandrous elements are serially juxtaposed in a plane defined by the fiat conductor, so as to form a filter structure.

17 Claims, 11 Drawing Sheets

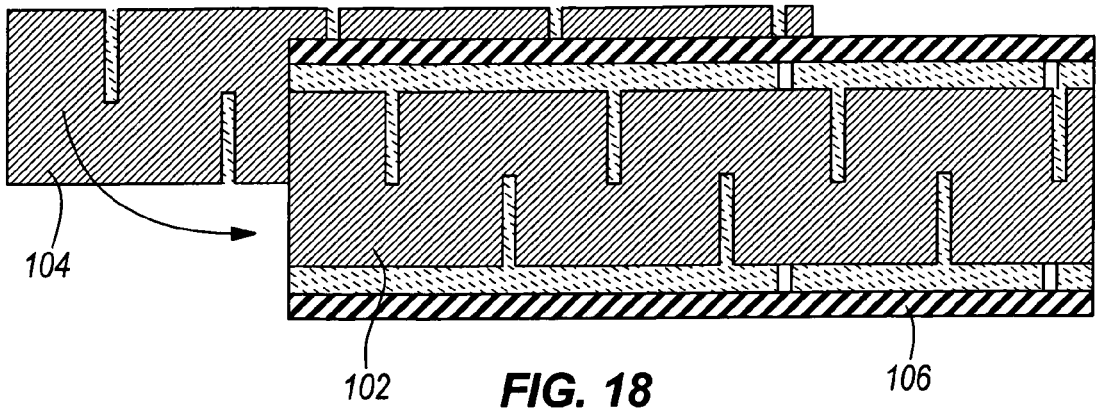
FIG. 18
FIG. 19
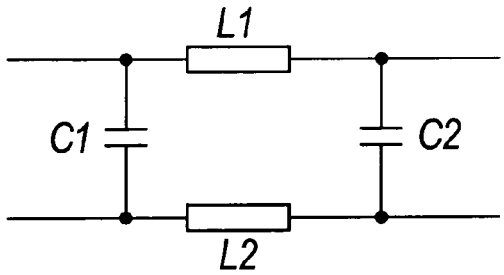
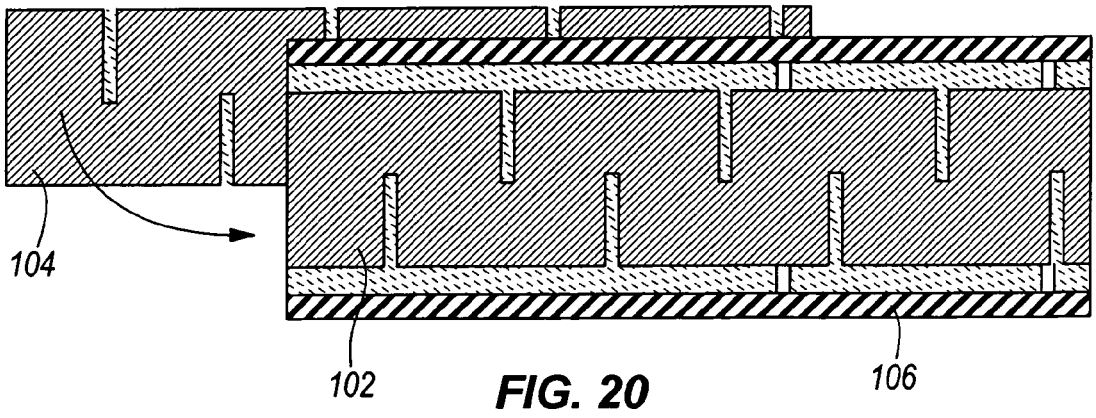
FIG. 20
FIG. 21
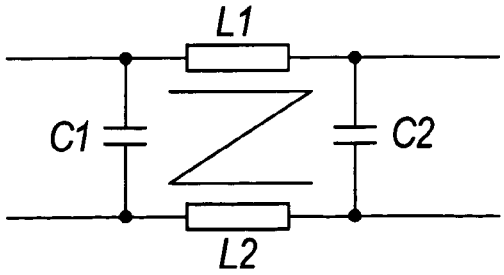

FLEXIBLE FLAT CONDUCTOR WITH INTEGRATED OUTPUT FILTER

BACKGROUND OF THE INVENTION

1. Field of the Invention

The present invention generally relates to a flexible flat conductor with at least two electrically conductive layers, which are at least partially surrounded by an electrically insulating cover, the electrically conductive layers being insulated from one another by at least one dielectric layer arranged between them.

Furthermore, the invention relates to a power supply unit which includes such a flexible flat conductor.

2. Description of the Related Art

Power supplies and chargers in the low power range are implemented nowadays as a switched mode power supply unit to meet requirements in respect of the wide input voltage range and low losses. An embodiment of this device which is in widespread use takes the form of a plug-in power supply unit 1, wherein an electronic circuit for power conversion is accommodated in a housing located in the immediate vicinity of the mains plug, as shown in FIG. 1. A plurality of such devices is used for charging portable devices such as mobile phones, PDAs, CD/DVD/MD/MP3 playback devices and the like. Portability is largely a question of the size of the charger, its weight and ease of transport. The connection to the consumer (not shown in the figure) is normally effected by means of an output plug 2 and a two-pole output line 3, which is a round line or twin line, as is shown in FIG. 1.

In addition, it is known to use in such power supply units flat cables equipped with a wind-up device. An example of such an arrangement is shown e.g. in JP 2001/128350 and WO 01/21521 A1. Such arrangements allow for a particularly space-saving and orderly accommodation of the cable during transport.

Power conversion is normally achieved nowadays with a flyback converter, which is preferred on account of its comparatively uncomplicated circuitry in this power range. If the energy transmission takes place by means of primary control, as shown in DE 100 18 229 A1, only a diode for rectification and an LC filter for filtering the output voltage are provided on the secondary side. A circuit diagram of such a known output-side circuit is shown in FIG. 2. Whereas a ceramic capacitor is normally employed for the capacitor C2 in FIG. 2 an electrolytic capacitor is usually chosen for the capacitor C1 to meet the requirements of low equivalent series resistance at minimal cost. Typical characteristic values for the components shown in FIG. 2 are:

C1: 22 μF . . . 470 μF

L: 1 μH . . . 100 μH

C2: 10 pF . . . 10 μF

As is shown in FIG. 3, this arrangement is usually followed by a current-compensated choke L3' with terminating filter capacitor C3 in order to suppress common mode interference. As traditional discrete components the filter arrangements shown in FIGS. 2 and 3 occupy a considerable amount of space in the plug-in power supply unit and thus hinder further miniaturization of the power supply unit. Additionally, high-frequency interference may be coupled in via the output line. This usually necessitates an additional input filter within the consumer, thus resulting in an increase in the size, weight and cost of the consumer.

Finally, the practice of fabricating filter structures integrated with a flexible flat conductor in order to make them as simple, cheap and compact as possible is known. A flexible flat cable with electronic components integrated therein is known from Japanese Laying Open Publication JP 06-139831 A. Various conductive structures surrounded by an electrical insulation are here insulated from one another by a further dielectric layer so that a capacitor is formed. By means of a meandrous patterning of the conductor levels, an inductance can be realized after a subsequent folding process wherein the individual meanders are superimposed in the shape of a concertina folding in the third dimension. Here the combination of capacitance and inductance provides an integrated filter.

However, this solution is disadvantageous in that, in order to implement the inductances needed for a filter structure, the flexible flat conductor must be folded many times in a particular way, resulting not only in an increased outlay during production but also to more space being needed. In addition, as a consequence of the necessary folding of the flexible flat conductor according to JP 06-139831 A only certain regions of the flexible flat conductor can be utilized for the integrated filter structure, thus leaving long stretches of the cable unused.

SUMMARY OF THE INVENTION

An improved flexible flat conductor and also a power supply unit with such a flat conductor are therefore provided, wherein the filtering can be ameliorated, the amount of space required can be reduced and, at the same time, the cost of manufacture can be lowered.

In one embodiment, a flexible flat conductor includes at least two electrically conductive layers which are at least partially surrounded by an electrically insulating cover, wherein said electrically conductive layers are electrically insulated from one another by at least one dielectric layer arranged therebetween. At least a first one of said electrically conductive layers is patterned in at least one subarea thereof by openings in such a way that a plurality of meandrous elements is formed, and said meandrous elements are serially juxtaposed in a plane defined by the flat conductor, so as to form a filter structure.

According to a further development, a power supply unit having a primary-side connector and a secondary-side connector is provided, wherein the secondary-side connector is connected to the power supply unit via a flexible flat conductor. Said flexible flat conductor includes at least two electrically conductive layers which are at least partially surrounded by an electrically insulating cover, wherein said electrically conductive layers are electrically insulated from one another by at least one dielectric layer arranged therebetween. At least a first one of said electrically conductive layers is patterned in at least one subarea thereof by openings in such a way that a plurality of meandrous elements is formed, and said meandrous elements are serially juxtaposed in a plane defined by the flat conductor, so as to form a filter structure.

BRIEF DESCRIPTION OF THE DRAWINGS

The accompanying drawings are incorporated into and form a part of the specification for the purpose of explaining the principles of the invention. The drawings are not to be construed as limiting the invention to only the illustrated and described examples of how the invention can be made and used. Further features and advantages will become apparent from the following and more particular description of the invention which is illustrated in the accompanying drawings, wherein:

FIG. 18 shows a flexible flat conductor according to a further embodiment;

FIG. 19 shows the electric equivalent circuit of the structure according to FIG. 18;

FIG. 20 shows a further advantageous embodiment of the flexible flat conductor according to the present invention;

FIG. 21 shows the equivalent circuit of the arrangement according to FIG. 20;

DETAILED DESCRIPTION OF THE INVENTION

The illustrated embodiments of the present invention will be described with reference to the figure drawings wherein like elements and structures are indicated by like reference numbers.

Figure 4:
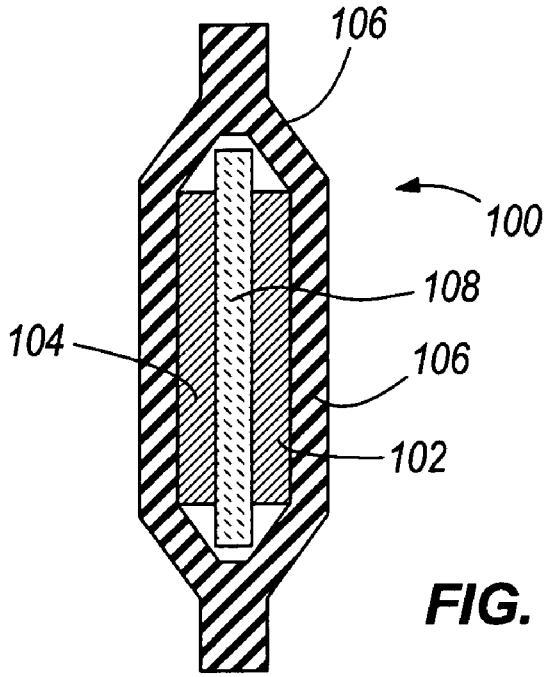
FIG. 4 shows a cross-section through the flexible flat conductor according to the present invention.
Figure 5:
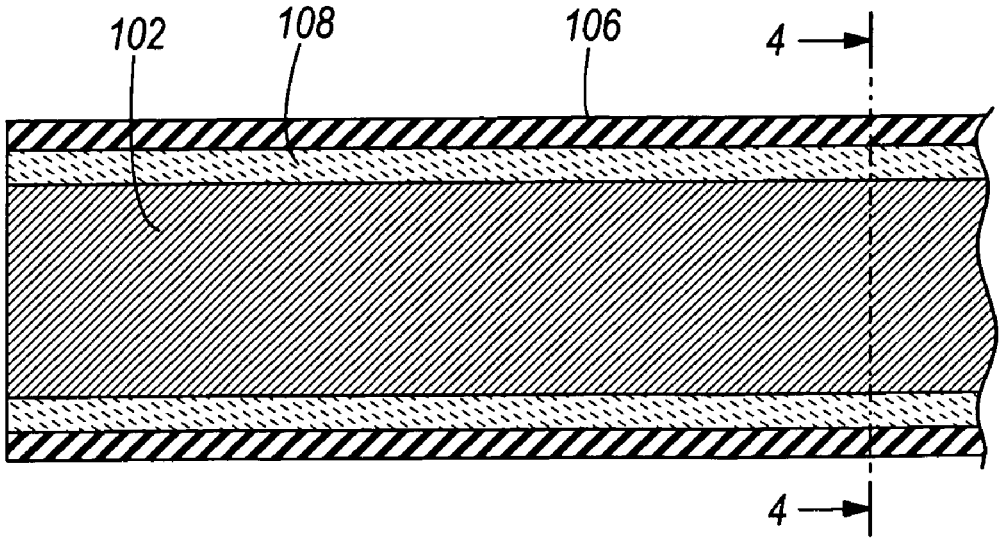
FIG. 5 shows a schematic representation of the flexible flat conductor according to FIG. 4 in a top view.

Referring now to the drawings and in particular to FIG. 4, a cross-section through a flexible flat conductor 100 according to the present invention is shown. The flexible flat conductor 100 comprises two electrically conductive layers 102 and 104 which are surrounded by an electrically insulating cover 106. In order to integrate the function of a filter into the flexible flat conductor 100, the two electrically conductive layers 102, 104, which may be made e.g. of copper or of aluminium, are separated from one another by a dielectric 108 in accordance with the present invention. This results, without further patterning of the metallic layers 102 and 104, in a capacitance between the conductors, which is calculated according to the following equation [1]:

$$C=\in_0\in_r A/d \qquad [1]$$

The dielectric used is preferably a flexible ceramic dielectric which has a dielectric constant of $\in_r$=100 to 5000 and which is embedded between the two layers of the metallic conductors 102, 104 and joined to two outer insulating foils 106 by laminating.

According to an advantageous embodiment, an output line according to the present invention can have a total length of two meters and a cross-section of 2×0.25 mm$^2$. The geometric and electric parameters can have e.g. the following values: width of the copper foil 7 mm, thickness of the copper foil 35 μm, thickness of the dielectric layer 5 μm, relative dielectric constant $\in_r$=1000 and thickness of the insulating foil 25 μm.

Figure 1:
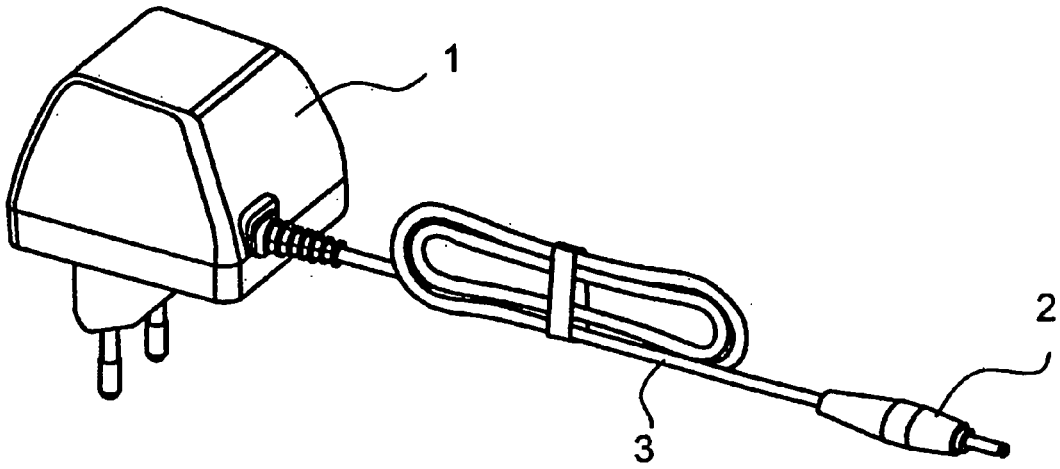
FIG. 1 Prior Art
FIG. 1 shows a perspective representation of a plug-in power supply unit according to the prior art.
Figure 22:
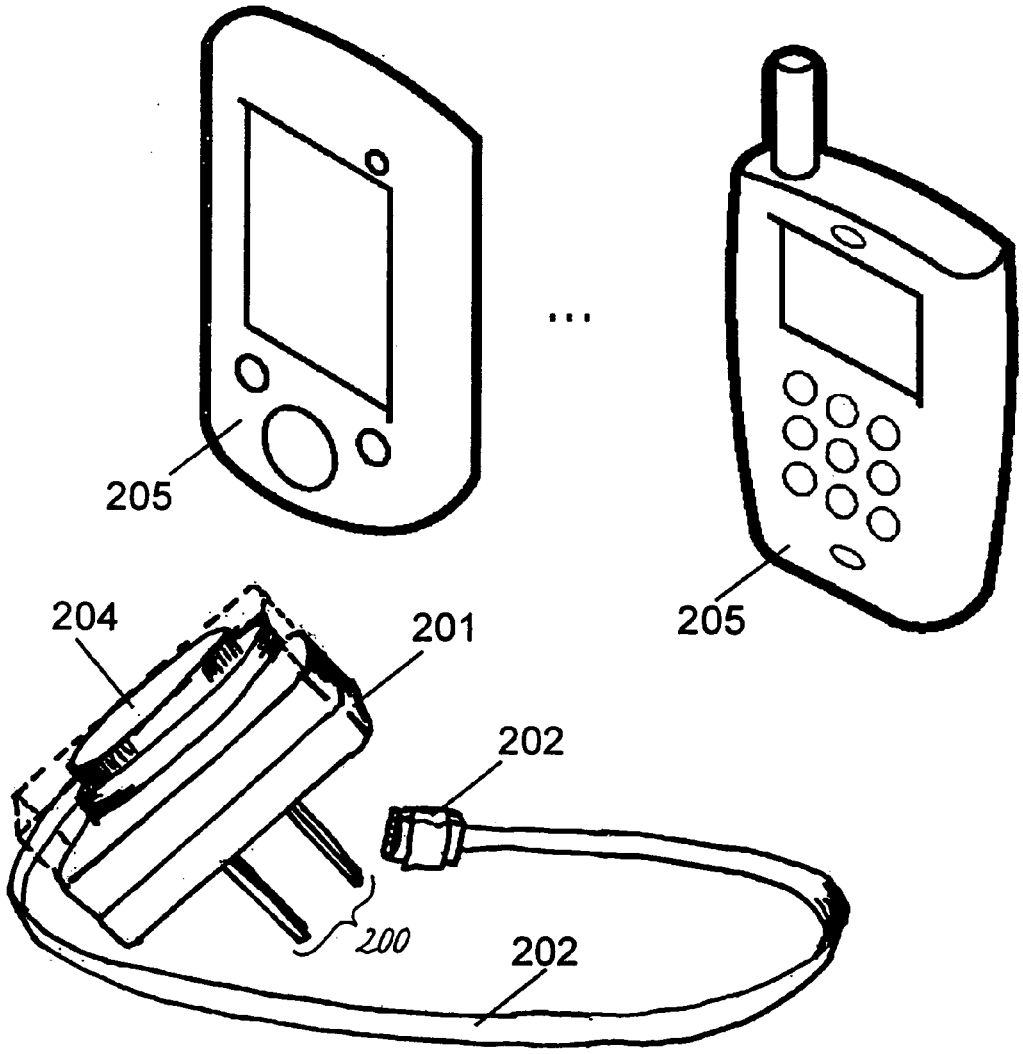
FIG. 22 shows the perspective representation of a power supply unit with a flexible flat conductor according to the present invention.

In order to achieve a uniform lamination of the outer insulating layers 106, the line 100 has a resultant overall width of 7.5 mm and a thickness of only 0.125 mm. These dimensions are particularly suitable for space-saving winding up, when the flexible flat conductor 100 is used in a power supply unit, as shown in FIG. 22. In comparison with a conventional round conductor (shown e.g. in FIG. 1), such a flexible flat conductor will occupy 22% less space.

The above-mentioned exemplary parameter values result in a total capacitance of approx. 25 μF between the two conductors 102 and 104. In the case of switched mode power supply units with a switching frequency of e.g. 100 kHz, this value will suffice for obtaining sufficient filtering of the output voltage. In addition, the ceramic dielectric 108 has better high-frequency characteristics, in particular a lower equivalent series resistance (ESR), than a comparable electrolytic capacitor, so that, in spite of the comparatively low capacitance, a sufficiently low voltage ripple will be achieved at the end of the line. In addition, due to the area distribution of the capacitance over the whole surface of the line in combination with the excellent heat transfer provided by the copper electrodes, the self-heating effect occurring in the case of the flexible flat conductor 100 will be low, even if high currents flow through the dielectric.

Figure 6:
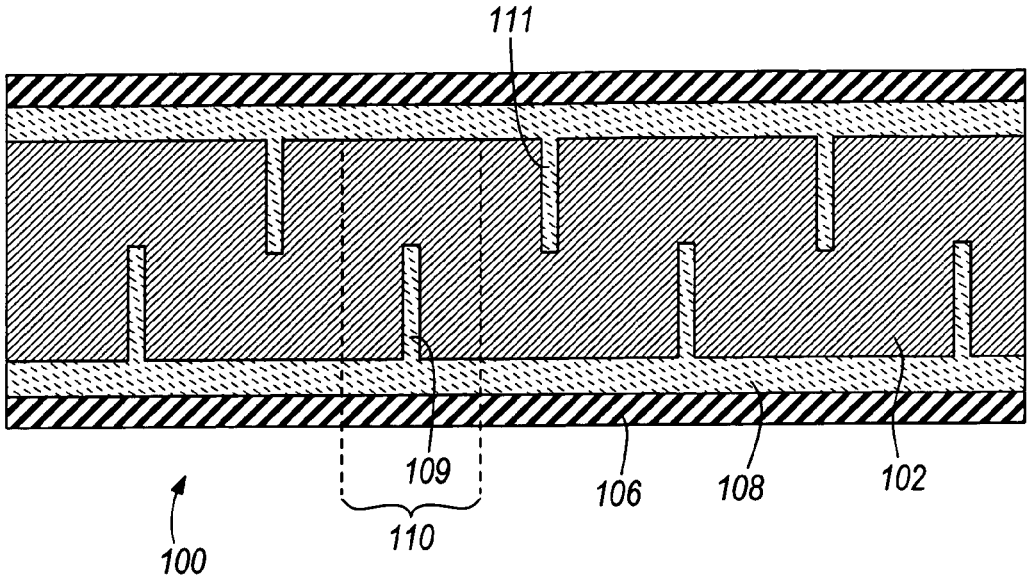
FIG. 6 shows a top view of a first embodiment the flexible flat conductor according to the present invention.

According to the present invention, the first layer of the two electrically conductive layers 102 is patterned such that a meandrous structure is formed, this kind of structure being shown in FIG. 6. According to a first embodiment of the present invention, the opposite copper foil 104 remains unpatterned, whereby an inductance connected in parallel to the capacitor is formed. The value of said inductance can be calculated approximately on the basis of the formula for a flat square coil with a single turn.

According to the present invention, individual meandrous elements 110 are serially juxtaposed in the plane of the flexible flat conductor so as to establish the necessary inductance.

In the meandrous structure shown in FIG. 6, which consists of a serial juxtaposition of meandrous elements 110 that are defined by respective openings 109, 111 having a comparatively small area, the inductance required for an integrated filter can be established in an elegant way exclusively within the plane of the flexible flat conductor, without the necessity of providing e.g. a folding of the type shown in JP 06-139831. If necessary, the whole length of the flexible flat conductor can, in this way, be provided with meandrous elements 110 for said inductance. This is, however, not absolutely necessary, but depends on the respective parameters required.

Figure 7:
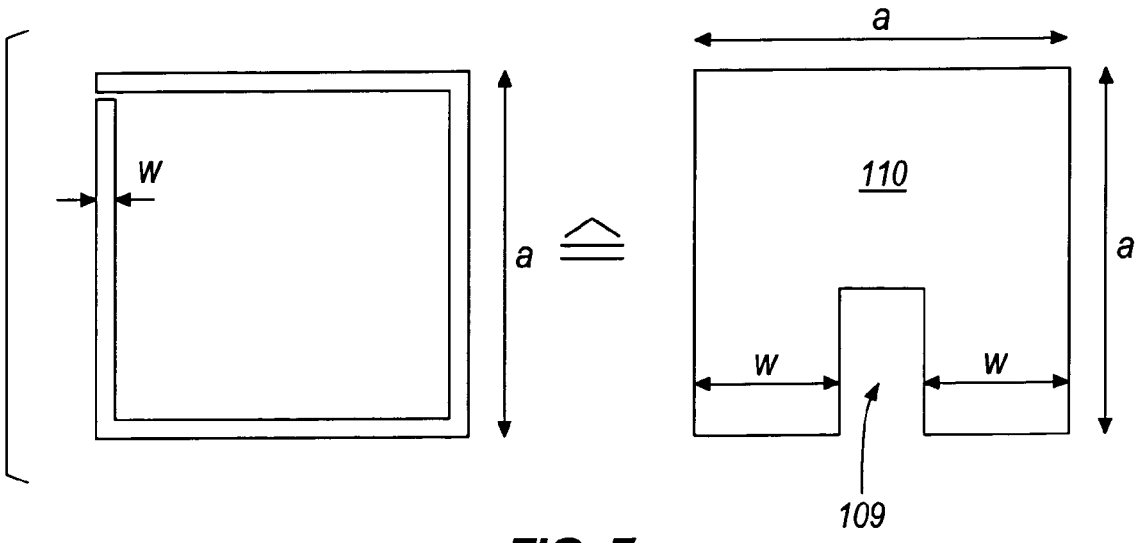
FIG. 7 shows a schematic representation of a single meandrous structure according to FIG. 6.

The inductance obtained will now be calculated approximately with reference to FIG. 7. It will here be assumed that the inductance of the meandrous element 110 shown in FIG. 7 can be approximated by the basic geometry of a flat square coil with only one turn having a turn diameter a and a conducting track width w. The inductance L of such a meandrous element 110 can then be calculated according to the following equation [2]:

$$L\ [\mu\text{H}] = 0.0467\ aN^2\left\{\log_{10}\left(2\frac{a^2}{t+w}\right) - \log_{10}(2.414a)\right\} + 0.02032aN^2\left\{0.914 + \left(\frac{0.2235}{a}(t+w)\right)\right\} \quad [2]$$

The individual meandrous element 110 of FIG. 7 is characterized in that it is defined by a comparatively small slot 109 in the electrically conductive material of the conducting track 102. Between the individual meandrous elements 110, slots 111 are arranged, which have the same dimensions as the slots 109 in the embodiment shown. The slot may, for example, have a length of approx. 3.5 mm and a width of only 0.2 mm. It follows that, when the edge length a is 7 mm, the remaining conducting track width w will be 3.4 mm. When these two values are inserted in equation [2], a single meandrous element 110 having the above-mentioned dimensions will have an inductance of approx. 9 nH. The thickness t of the metallization was assumed to be 35 μm for this calculation.

A juxtaposition of meandrous elements 110 over the whole two-meter length of the flexible flat conductor would therefore lead to an inductance of 2.5 μH. Due to the special geometry of the meandrous elements, the dc resistance will only increase insignificantly by approx. 1.4%.

Figure 8:
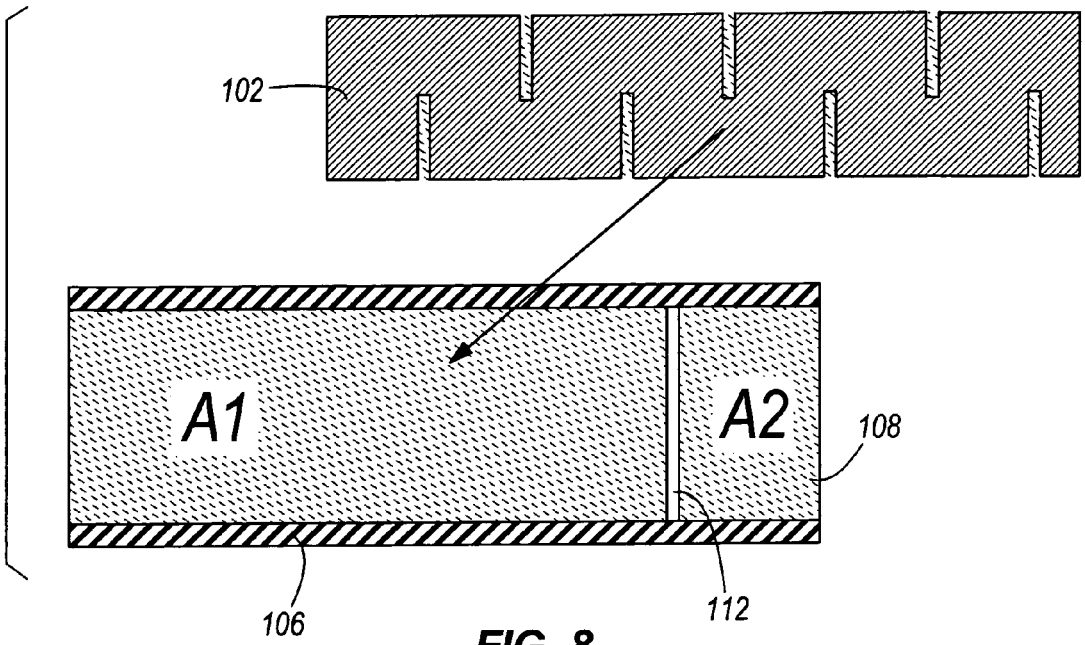
FIG. 8 shows a schematic representation of a flexible flat conductor according to a second advantageous embodiment.

FIG. 8 shows a further advantageous embodiment of the present invention. When the dielectric 108 is interrupted by a slot 112 which is arranged transversely to the longitudinal axis of the flexible flat conductor, two subareas A1 and A2 will be obtained (to make things clearer, the patterned layer 102 is shown at a raised position). The equivalent circuit of the structure in FIG. 8 is the Π filter according to FIG. 2.

By displacing the slot 112 along the length of the flexible flat conductor 100 at a constant inductance, an arbitrary division of the total capacitance can be achieved. In the case of the above-mentioned dimensions, each millimeter of length stands for a capacitance of approx. 10 nF. In view of manufacturing tolerances, the minimum dimension of one of the dielectric areas A1, A2 should, however, not be smaller than approx. 1 mm.

Figure 9:
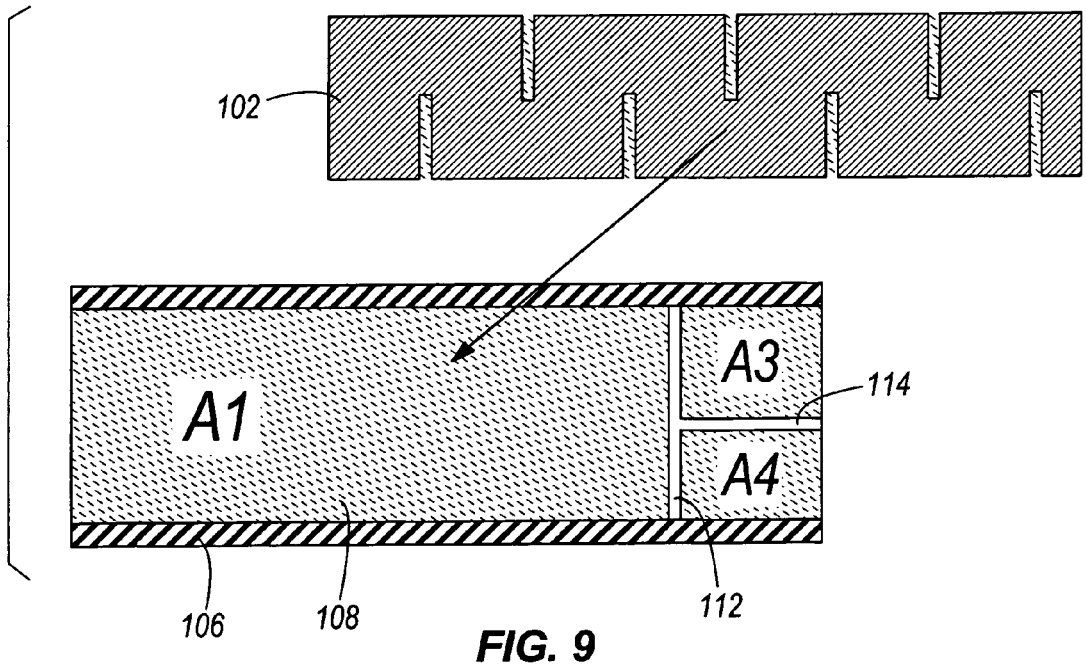
FIG. 9 shows a schematic representation of a flexible flat conductor according to a third advantageous embodiment.

As a filtering capacitance in mobile telecommunications equipment, such as mobile phones, a small capacitance is particularly desirable at the line end so as to prevent the carrier from being coupled into the megahertz frequency range. This can be achieved by an additional slot 114 provided in the dielectric 108 and extending in the direction of the longitudinal axis of the flexible flat conductor. This additional embodiment is schematically shown in FIG. 9. In the case of this embodiment, two separate capacitors with half the capacitance are obtained, which are symbolized by the areas A3 and A4 and which are connected in series via the back surface metallization 104. A resultant capacitance of approx. 2.5 nF is obtained in this way. When the cross-section 114 is arranged asymmetrically, so that the area A3 is approx. ⅙ A4, the capacitance resulting from equation [3] is as follows:

$$1/Cges = 1/C3 + 1/C4 \quad [3]$$

$$= 1/1.5\ \text{nF} + 1/9\ \text{nF}$$

-continued $$\approx 1.35\ \text{nF}$$

A minimum capacitance within the framework of today's design rules is obtained when a plurality of transverse slots 114 are implemented with a width that is so broad that only three dielectric areas of 1 mm×1 mm remain. This will result in a total capacitance of approx. 100 pF in the series connection.

A substantial advantage of the present invention is to be seen in the fact that this capacitance is located very close to the consumer and that interfering frequencies, which are coupled in via a conventional line, are therefore suppressed much more effectively. This has the effect that additional filtering can perhaps be dispensed with in the consumer and that the consumer can be produced more simply and at a lower price.

By selecting various longitudinal and transverse strips 112, 114, arbitrary filter combinations within the framework of the maximum capacitances and inductances can be produced. Also multistage filters can be produced in this way.

Figure 10:
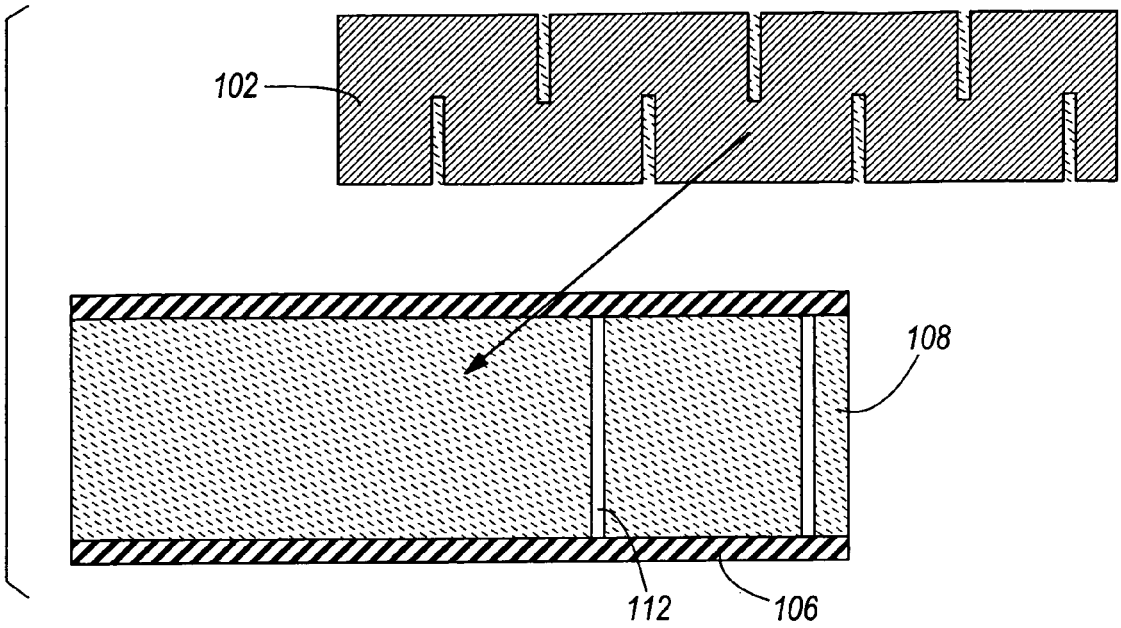
FIG. 10 shows a schematic representation of a flexible flat conductor according to a fourth advantageous embodiment.

FIG. 10 shows a flexible flat conductor 100 having integrated therein a multistage filter of this type. The associated electric equivalent circuit is shown in FIG. 11.

Figure 11:
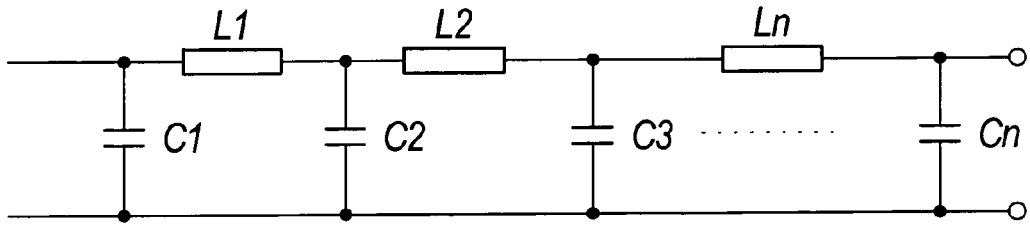
FIG. 11 shows an electric equivalent circuit of the arrangement according to FIG. 10.
Figure 12:
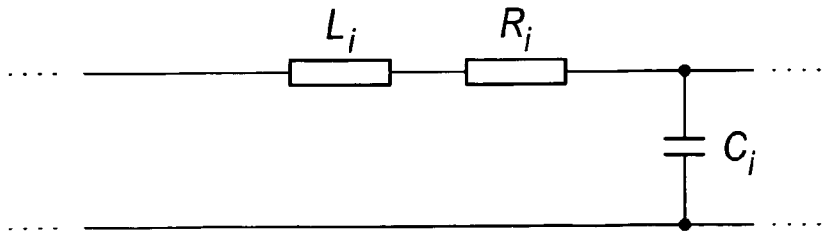
FIG. 12 shows a generic stage of the equivalent circuit according to FIG. 11.

For elucidating the great variety of possibilities existing for implementing the filter characteristic, the filter of FIG. 11 is split into respective generic stages. Each stage is assumed to have a longitudinal inductance of 9 nH with an ohmic resistance of approx. 100 mΩ and a transverse capacitance C1 of 85 nF. FIG. 12 shows schematically the generic stage "i".

Figure 13:
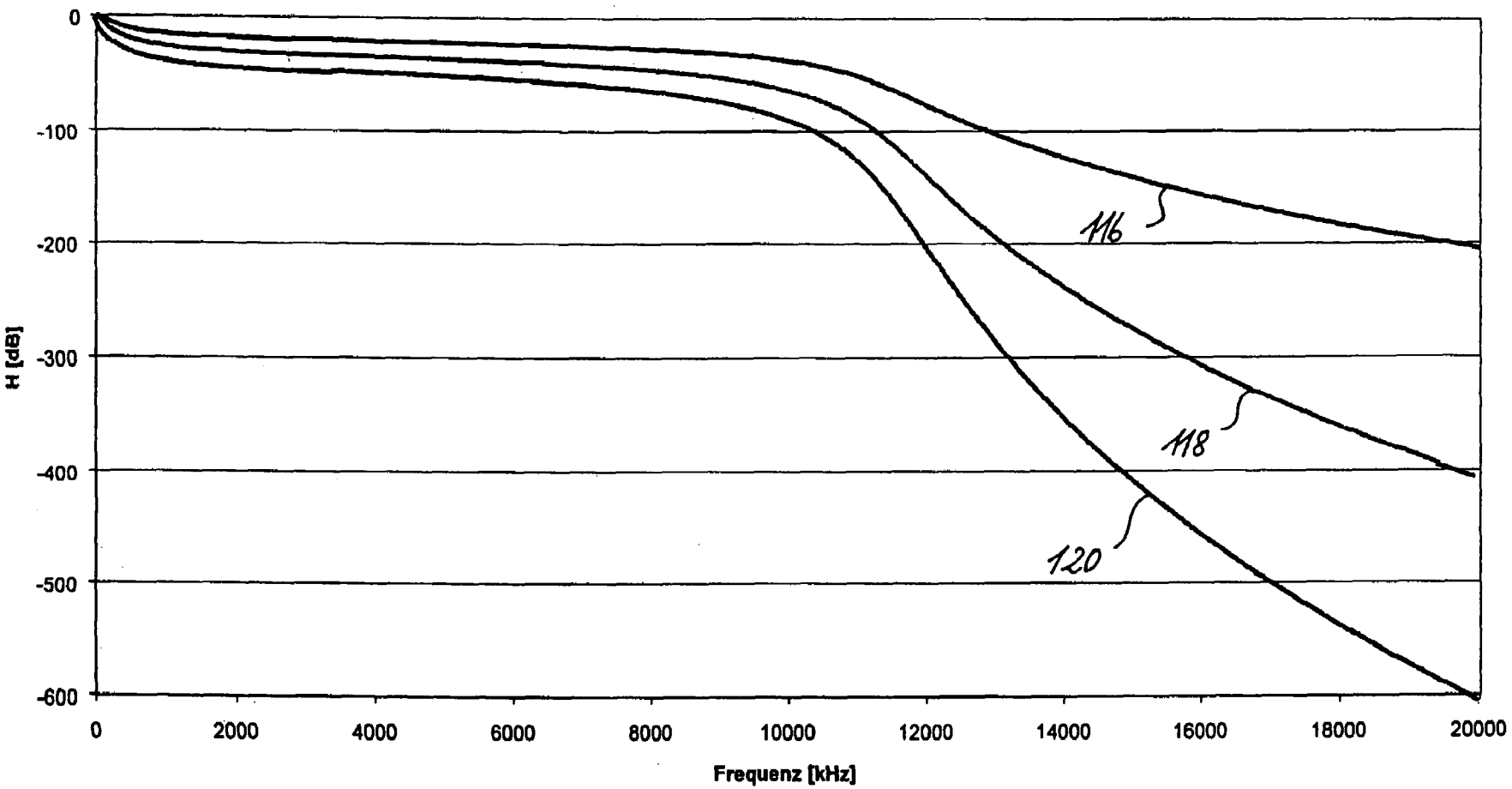
FIG. 13 shows a transfer function for a filter with 10, 20 or 30 stages according to FIG. 12.

FIG. 13 shows the transfer functions for flexible flat conductors with 10, 20 and 30 stages. Reference numeral 116 designates the curve 10 for juxtaposed generic stages according to FIG. 12, curve 118 represents the transfer function for 20 stages and curve 120 represents the transfer function for 30 stages. As can be seen from FIG. 13, the limiting frequency remains constant when the number of stages is increased, only the filter steepness will increase. In a frequency range of less than 100 kHz, the filter effect is comparatively low.

Figure 14:
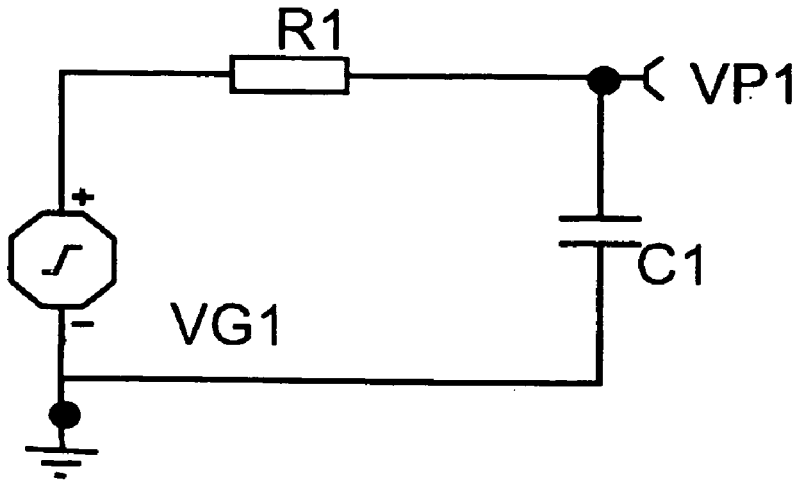
FIG. 14 shows an electric equivalent circuit of the arrangement according to FIG. 5.

When the flexible flat conductor does not have a meandrous structure in the electrically conductive layer 102, 104, i.e. when the inductance is negligible, only the capacitance is effective and a simple RC filter of the type shown in FIG. 14 is obtained. The total capacitance that can be achieved over a length of 2 m is C1=25 μF.

Figure 15:
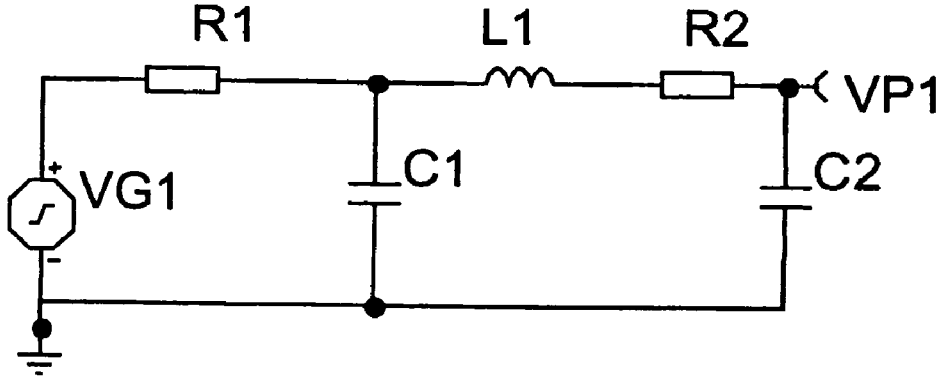
FIG. 15 shows an electric equivalent circuit of an RCLC filter.
Figure 16:
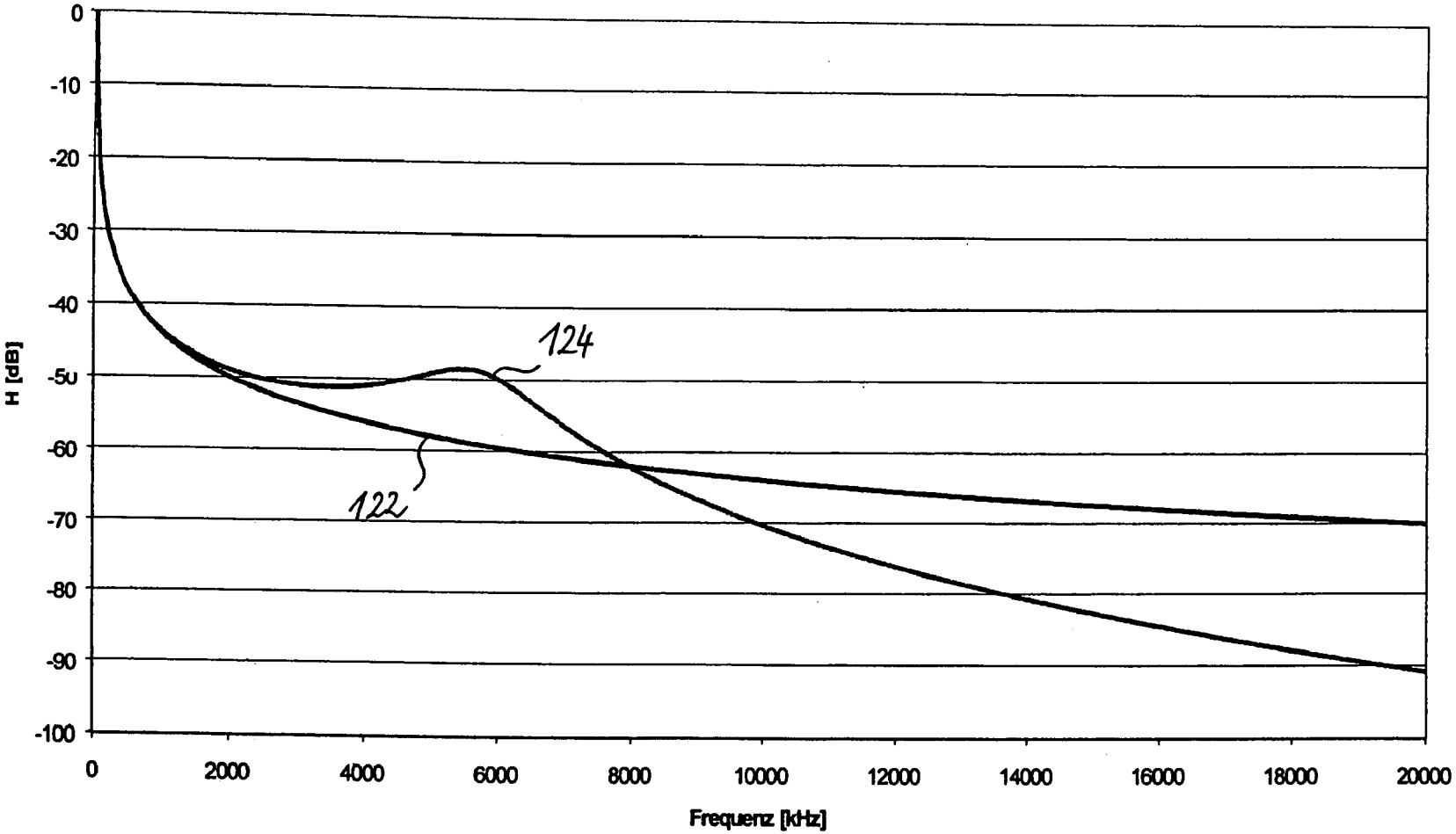
FIG. 16 shows the transfer functions of the filter structures according to FIGS. 14 and 15.

In order to improve the high-frequency characteristics, an LC circuit can be connected downstream of this arrangement by patterning the flexible flat conductor only in close vicinity to the consumer. The resultant filter is the RCLC filter shown in FIG. 15 as an equivalent circuit. The transfer functions of the filter structures according to FIG. 14 and FIG. 15 are shown in FIG. 16 in dependence upon the frequency. Curve 122 represents the transfer function of the simple RC filter according to FIG. 14 and curve 124 represents the transfer function of the RCLC filter according to FIG. 15. As can be seen from curve 124, a resonance of approx. 5.5 MHz occurs in the case of the RCLC filter. This is the resonant frequency of the LC circuit. From approx. 8 MHz onwards, the attenuation becomes better than in the case of the simple RC filter. The limiting frequency (and therefore the high-frequency attenuation characteristics) can be influenced by varying the values for the LC filter.

Figure 17:
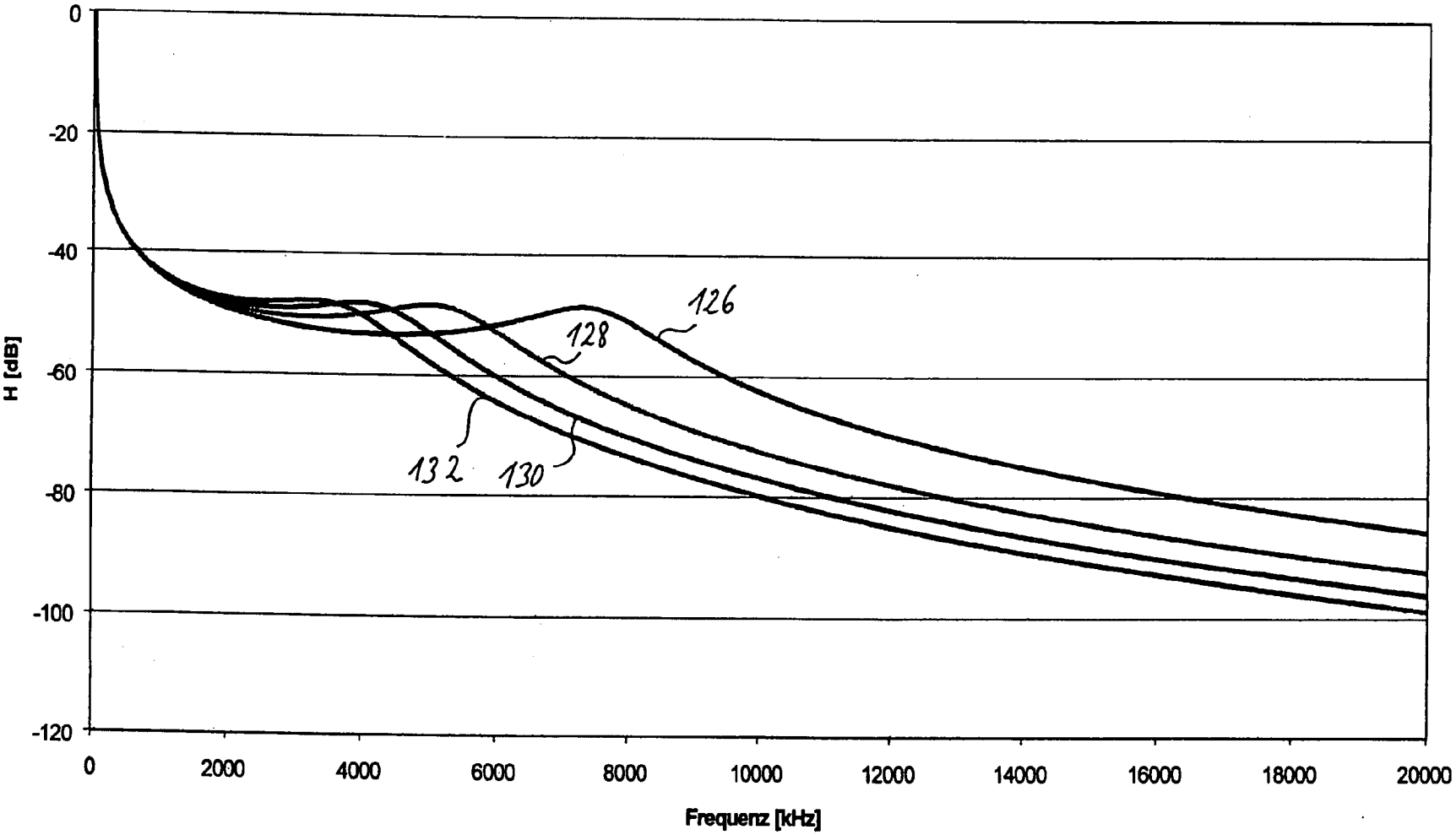
FIG. 17 shows various transfer functions of the structure according to FIG. 15.

FIG. 17 shows various transfer functions of the filter according to FIG. 15 when the values for the capacitance C2 are varied. The value of the capacitance C2 was here varied in 50 nF steps in the range of from 50 nF to 200 nF. The limiting frequency decreases when the value of C2 increases. This can be achieved in an analogous manner by a variation of the inductance L1. In FIG. 17, curve 126 represents the transfer function for C2=50 nF, curve 128 represents the transfer function C2=100 nF, curve 130 represents C2=150 nF, and curve 132 represents a value of C2=200 nF.

A further increase in inductance can be obtained by patterning both conductor areas 102, 104 on the upper and on the lower surface of the dielectric 108 in a meandrous shape. Utilizing the full length, the inductance can thus be doubled once more.

A push-pull filter (also referred to as differential mode filter) is obtained over the length in question, as can be seen in FIG. 18; in the case of this filter, an effective capacitance of up to 22 μF and an effective inductance of up to 7 μH can be achieved with the above-mentioned parameters. This configuration is obtained when the two conductor areas are patterned congruently, i.e. with co-directionally arranged meandrous elements 110.

The equivalent circuit corresponding to the arrangement according to FIG. 18 is shown in FIG. 19.

When the two conductor areas 102, 104 are, however, oriented in a mirror-inverted manner, as shown in FIG. 20, so that the meandrous elements 110 are arranged contradirectionally, a common mode filter 110 will be obtained whose equivalent circuit is shown in FIG. 21. Co-directional interferences can in this way be eliminated by the contradirectional fields of the two inductances on the upper and lower surfaces.

The flexible flat conductor according to the present invention can be used in a particularly advantageous manner for a mains power supply of the type shown in FIG. 22. The flexible flat conductor is here used as an output line 203 which establishes the connection between the actual power supply unit 201 and an output plug 202. The output plug 202 can, as indicated in FIG. 22, be connected to a plurality of different consumers 205 (e.g. mobile phones, PDAs, CD/DVD/MD/MP3 playback devices and the like) so as to supply these devices with electric energy. In the embodiment shown, the power supply unit 201 is provided with a wind-up device 204 which may be implemented e.g. similar to the wind-up device shown in Japanese Laying Open Publication JP 2001/128350 A. The cover of the power supply unit 201 is indicated in FIG. 22 only by a broken line so as not to endanger clarity.

When the flexible flat conductor according to the present invention is used as an output line 203, a great variety of filter arrangements can be realized within the given geometry of this output line. In addition to the reduced dimensions of the line arrangement, the power supply unit 201 will especially be implemented such that it occupies less space and that the power supply costs are reduced. Space and costs can, however, also be reduced in a terminal equipment, which is to be connected to the plug 202 and which is not shown here, since a separate input filter can be dispensed with. Due to the planar structure of the flexible flat conductor according to the present invention, tolerance deviations will be small in combination with a high reproducibility and an easier producibility, i.e. the filter structures can be formed with a high reproduction degree.

The solution according to the present invention is based on the finding that a particularly simple and space-saving realization of a filter structure can be achieved by means of an integrated arrangement wherein at least one of the electrically conductive layers of the flexible flat conductor is patterned by openings in a way that a plurality of meandrous elements is formed and wherein the meandrous elements are serially juxtaposed in a plane defined by the flat conductor, so as to form the filter structure. This solution enables costly process steps, such as the folding of the flat conductor, to be dispensed with. Furthermore, the flexibility in the creation of e.g. an output filter in a power supply unit is increased considerably since the whole length of the of the line can be used for the filter. The cable remains flexible over its whole length and a wind-up device e.g. can be employed without any problem. For this purpose a flexible ceramic dielectric is preferably embedded between the electrically conductive layers.

According to a further preferred development the openings occupy less than 50% of the area of each meandrous element. As a result, a sufficiently high inductance can be achieved without the dc resistance being increased simultaneously by more than a small amount. The necessary capacitance can also be provided without any problem.

In particular, if the openings are defined by slots which extend over approx. 50% of the width of the first conductive layer transversely to the longitudinal axis of the flat conductor and which themselves have a width of less than 10% of their length, the increase in the dc resistance remains of the order of less than 1.5%.

According to a preferred further development of the present invention, the dielectric layer is subdivided into individual subareas by at least one opening. As a consequence various series- or parallel-connected capacitances can be realized advantageously.

Figure 2:
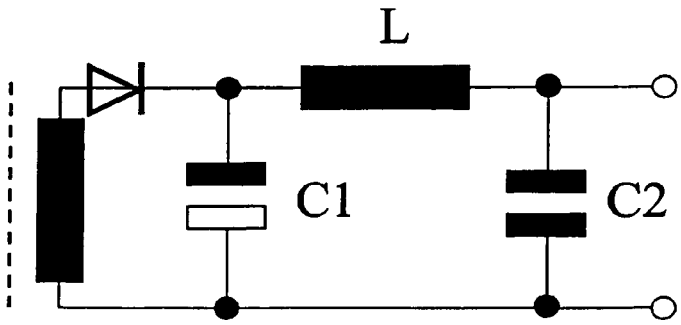
FIG. 2 Prior Art
FIG. 2 shows a circuit diagram of a secondary-side filter structure.
Figure 3:
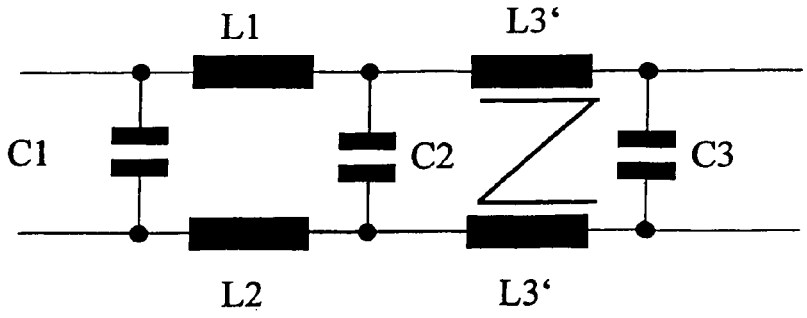
FIG. 3 Prior Art
FIG. 3 shows another secondary-side filter structure.

For example, the Π filters, as needed according to FIG. 2 e.g., can be formed via the appropriate circuiting of the meandrous structures in the first electrically conductive layer.

Furthermore, more complicated filter structures can be realized by providing openings, arranged both transversely to the direction of the longitudinal axis of the flexible flat conductor as well as in the direction of the longitudinal axis, in the dielectric layer. In this way a plurality of required filter structures can be realized at a very reasonable price.

By patterning an additional one of the electrically conductive layers in the same way, i.e. by forming meandrous structures, push-pull filters and common mode filters can be realized. This can be achieved very simply by arranging the meandrous structure either co-directionally (whereby a push-pull filter can be realized) or contra-directionally, whereby a common mode filter results.

The advantageous properties of the flexible flat conductor according to the present invention are of special value, when same is employed as the output line between the secondary-side plug-in connection and the power supply unit itself in a power supply unit with a primary-side plug-in connection and a secondary-side plug-in connection. Such a power supply unit has the advantage on the one hand that the space needed for the filter structures in the plug-in power supply unit can be reduced drastically and the advantage on the other that the system costs in the consumer, i.e. the mobile terminal, can be lowered since there is no need for an input filter. Furthermore, the functionality of the output filter can be matched to the requirements of the power supply unit while making only minimal demands on space and at no great cost.

The power supply unit according to the present invention can also be equipped with a wind-up device so as to roll up the flexible flat conductor at least partially, e.g. when transporting it or to shorten the output cable.

Finally, the solution according to the present invention permits the use of ecologically beneficial materials without additional softeners.

While the invention has been described with respect to the physical embodiments constructed in accordance therewith, it will be apparent to those skilled in the art that various modifications, variations and improvements of the present invention may be made in the light of the above teachings and within the purview of the appended claims without departing from the spirit and intended scope of the invention.

In addition, those areas in which it is believed that those ordinary skilled in the art are familiar have not been described herein in order not to unnecessarily obscure the invention described herein.

Accordingly, it is to be understood that the invention is not to be limited by the specific illustrated embodiments but only by the scope of the appended claims.

What is claimed is:

1. Flexible flat conductor including at least two electrically conductive layers which are at least partially surrounded by an electrically insulating cover, wherein said electrically conductive layers are electrically insulated from one another by at least one dielectric layer arranged therebetween, wherein at least a first one of said electrically conductive layers is patterned in at least one subarea thereof by openings in such a way that a plurality of meandrous elements is formed, wherein said meandrous elements are serially juxtaposed in a plane defined by the flat conductor, so as to form a filter structure, and wherein said openings are defined by slots which extend over approx. 50% of the dimensions of the patterned electrically conductive layer transversely to the longitudinal axis of the flat conductor and which have a width that amounts to less than 10% of their length.

2. Flexible flat conductor according to claim 1, wherein the respective openings occupy less than 50% of the area of each meandrous element.

3. Flexible flat conductor according to claim 1, wherein the dielectric layer is formed by a flexible ceramic dielectric.

4. Flexible flat conductor according to claim 1, wherein the dielectric layer is subdivided into individual subareas by at least one opening.

5. Flexible flat conductor according to claim 4, wherein two subareas of the dielectric layer are connected to the electrically conductive layers in such a way that a filter is formed.

6. Flexible flat conductor according to claim 4, wherein the individual subareas are produced by at least one opening extending transversely to the direction of the longitudinal axis of the flexible flat conductor and by at least one opening extending in the direction of the longitudinal axis of the flexible flat conductor.

7. Flexible flat conductor according to claim 1, wherein the first and a second electrically conductive layers are patterned such that co-directionally arranged meandrous elements are formed in at least one subarea of the flexible flat conductor, said meandrous elements being connected so as to form a push-pull filter.

8. Flexible flat conductor according to claim 1, wherein the first and a second electrically conductive layers are patterned such that contra-directionally arranged meandrous elements are formed in at least one subarea of the flexible flat conductor, said meandrous elements being connected so as to form a common mode filter.

9. Power supply unit having a primary-side connector and a secondary-side connector, wherein said secondary-side connector is connected to the power supply unit via a flexible flat conductor including at least two electrically conductive layers which are at least partially surrounded by an electrically insulating cover, wherein said electrically conductive layers are electrically insulated from one another by at least one dielectric layer arranged therebetween, wherein at least a first one of said electrically conductive layers is patterned in at least one subarea thereof by openings in such a way that a plurality of meandrous elements is formed, wherein said meandrous elements are serially juxtaposed in a plane defined by the flat conductor, so as to form a filter structure, and wherein said openings are defined by slots which extend over approx. 50% of the dimensions of the patterned electrically conductive layer transversely to the longitudinal axis of the flat conductor and which have a width that amounts to less than 10% of their length.

10. Power supply unit according to claim 9, wherein the respective openings occupy less than 50% of the area of each meandrous element.

11. Power supply unit according to claim 9, wherein the dielectric layer is formed by a flexible ceramic dielectric.

12. Power supply unit according to claim 9, wherein the dielectric layer is subdivided into individual subareas by at least one opening.

13. Power supply unit according to claim 12, wherein two subareas of the dielectric layer are connected to the electrically conductive layers in such a way that a filter is formed.

14. Power supply unit according to claim 12, wherein the individual subareas are produced by at least one opening extending transversely to the direction of the longitudinal axis of the flexible flat conductor and by at least one opening extending in the direction of the longitudinal axis of the flexible flat conductor.

15. Power supply unit according to claim 9, wherein the first and a second electrically conductive layers are patterned such that co-directionally arranged meandrous elements are formed in at least one subarea of the flexible fiat conductor, said meandrous elements being connected so as to form a push-pull filter.

16. Power supply unit according to claim 9, wherein the first and a second electrically conductive layers are patterned such that contra-directionally arranged meandrous elements are formed in at least one subarea of the flexible flat conductor, said meandrous elements being connected so as to form a common mode filter.

17. Power supply unit according to claim 9, wherein the flexible flat conductor is adapted to be rolled up by means of a wind-up device.

* * * * *